US007565866B1

(12) United States Patent
Downes

(10) Patent No.: US 7,565,866 B1
(45) Date of Patent: Jul. 28, 2009

(54) PAINTBALL GRENADE

(76) Inventor: Edward J. Downes, 2 Downey Dr., Manchester, CT (US) 06040

( * ) Notice: Subject to any disclaimer, the term of this patent is extended or adjusted under 35 U.S.C. 154(b) by 547 days.

(21) Appl. No.: 11/489,817

(22) Filed: Jul. 20, 2006

(51) Int. Cl.
*F42B 8/12* (2006.01)

(52) U.S. Cl. ..... 102/482; 102/498; 102/502

(58) Field of Classification Search ..... 102/357, 102/395, 440, 480, 482, 498, 502, 513, 529; 446/400, 401, 473; 473/577; 124/59, 73–77
See application file for complete search history.

(56) References Cited

U.S. PATENT DOCUMENTS 2,051,331 A * 8/1936 De Bobula ..... 102/487
4,498,880 A * 2/1985 Curley ..... 441/81
4,932,672 A * 6/1990 Tippmann ..... 473/611
5,018,449 A * 5/1991 Eidson, II ..... 102/498
5,240,450 A * 8/1993 Graham ..... 446/267
5,590,886 A * 1/1997 Lush ..... 473/577
5,877,448 A * 3/1999 Denton et al. ..... 102/401
5,996,503 A * 12/1999 Woodall et al. ..... 102/498
6,453,819 B1 * 9/2002 Coates ..... 102/498
6,598,807 B1 * 7/2003 Anzalone ..... 239/302
6,688,234 B2 * 2/2004 Huber et al. ..... 102/498
6,871,594 B1 * 3/2005 Estrella ..... 102/498
2006/0156943 A1 * 7/2006 Tippmann ..... 102/498

* cited by examiner

*Primary Examiner*—Troy Chambers

(57) ABSTRACT

A paintball grenade is disclosed. An illustrative embodiment of the paintball grenade includes a cage, a discharge housing carried by the cage, a vinegar syringe having a discharge tip carried by the discharge housing, a spoon pivotally carried by the discharge housing and engaging the vinegar syringe and a paint bladder carried by the cage.

20 Claims, 4 Drawing Sheets

PAINTBALL GRENADE

FIELD

The present invention relates to paintball accessories. More particularly, the present invention relates to a paintball grenade which discharges paint responsive to selective activation by a user.

BACKGROUND

Paintball games have enjoyed tremendous popularity in recent years. In paintball games, each of multiple players carries a paintball gun which is equipped with a canister of compressed gas such as carbon dioxide and a receptacle that contains multiple paintball pellets. Responsive to actuation of a trigger on the paintball gun, the compressed carbon dioxide gas forces a paintball pellet from a barrel of the gun. In the event that the ejected paintball pellet strikes a game participant, the paintball pellet bursts and splatters on the participant, representing a "hit", or gunshot wound, on the participant. The participants can be grouped together in teams, in which case the team that produces the greater number of "hits" on the other team is typically the winning team. Various paintball accessories have been devised to simulate the realism of an actual gunfight or military contest.

SUMMARY

The present invention is generally directed to a paintball grenade. An illustrative embodiment of the paintball grenade includes a cage, a discharge housing carried by the cage, a vinegar syringe having a discharge tip carried by the discharge housing, a spoon pivotally carried by the discharge housing and engaging the vinegar syringe and a paint bladder carried by the cage.

BRIEF DESCRIPTION OF THE DRAWINGS

The invention will now be described, by way of example, with reference to the accompanying drawings, in which.

DETAILED DESCRIPTION

Figure 2:
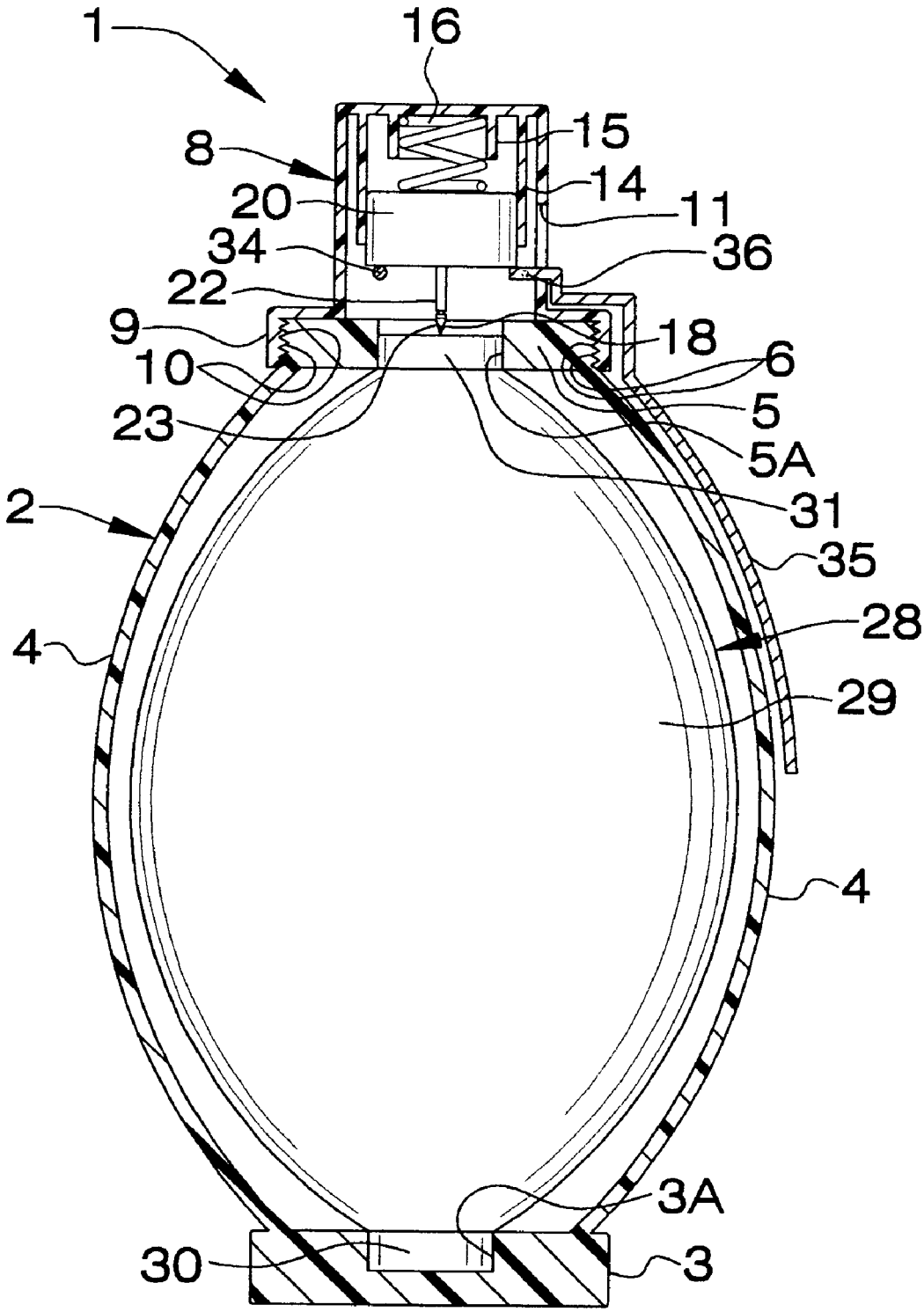
FIG. 2 is a longitudinal sectional view of an illustrative embodiment of the paintball grenade.
Figure 5:
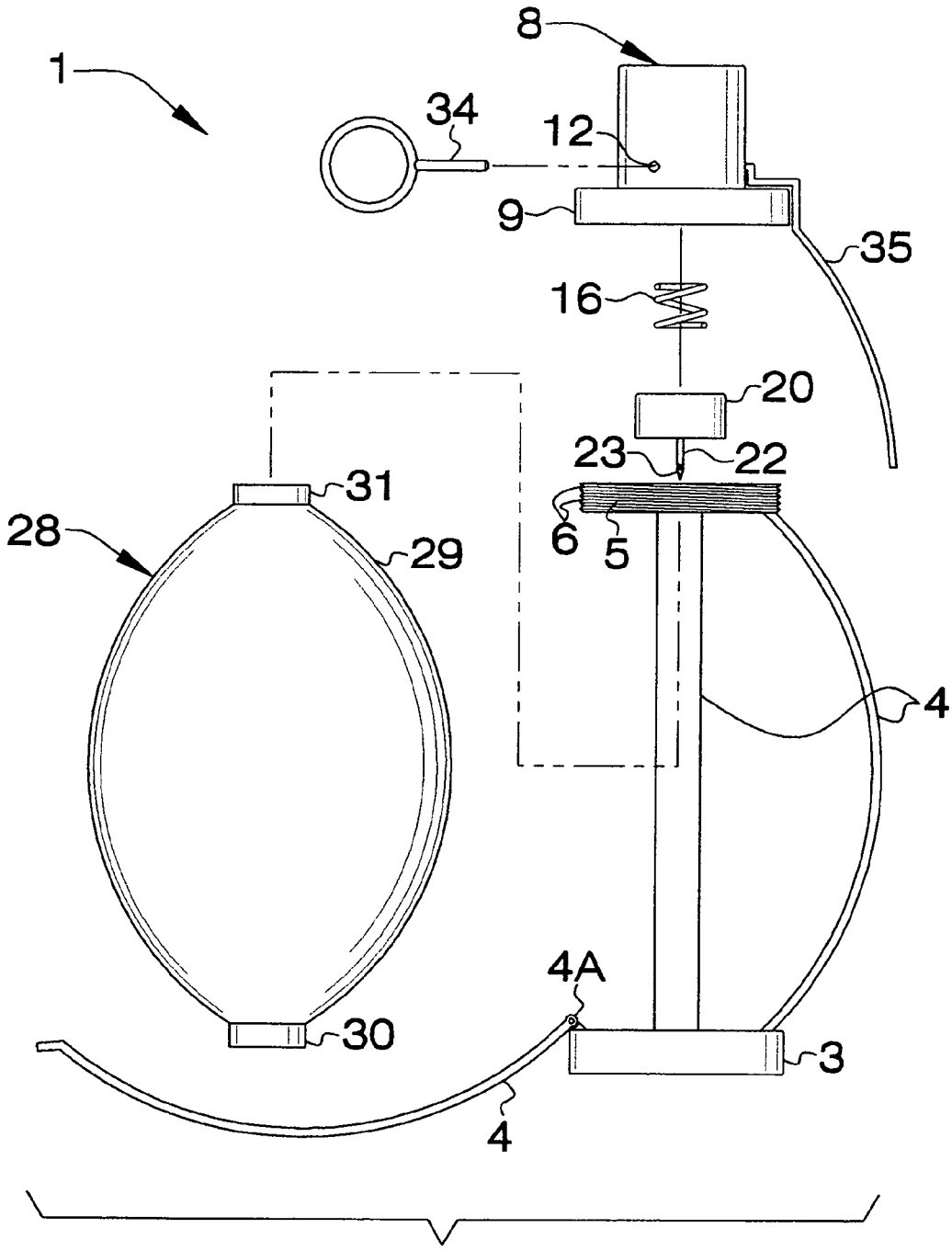
FIG. 5 is an exploded, perspective view of an illustrative embodiment of the paintball grenade.

Referring to the drawings, an illustrative embodiment of the paintball grenade is generally indicated by reference numeral 1. The paintball grenade 1 includes a cage 2 typically having a cage base 3. As shown in FIG. 2, a bladder cavity 3*a*, the purpose of which will be hereinafter described, is provided in the cage base 3. Multiple cage supports 4, each of which typically has a generally curved shape, extends from the cage base 3. As shown in FIG. 5, a support hinge 4*a* may attach at least one of the cage supports 4 to the cage base 3. A cage cap 5 is provided on the cage supports 4, in spaced-apart relationship with respect to the cage base 3. As shown in FIG. 2, a bladder cavity 5*a*, the purpose of which will be hereinafter described, is provided in the cage cap 5. Cap threads 6 are typically provided on an interior surface of the cage cap 5, for purposes which will be hereinafter described.

Figure 1:
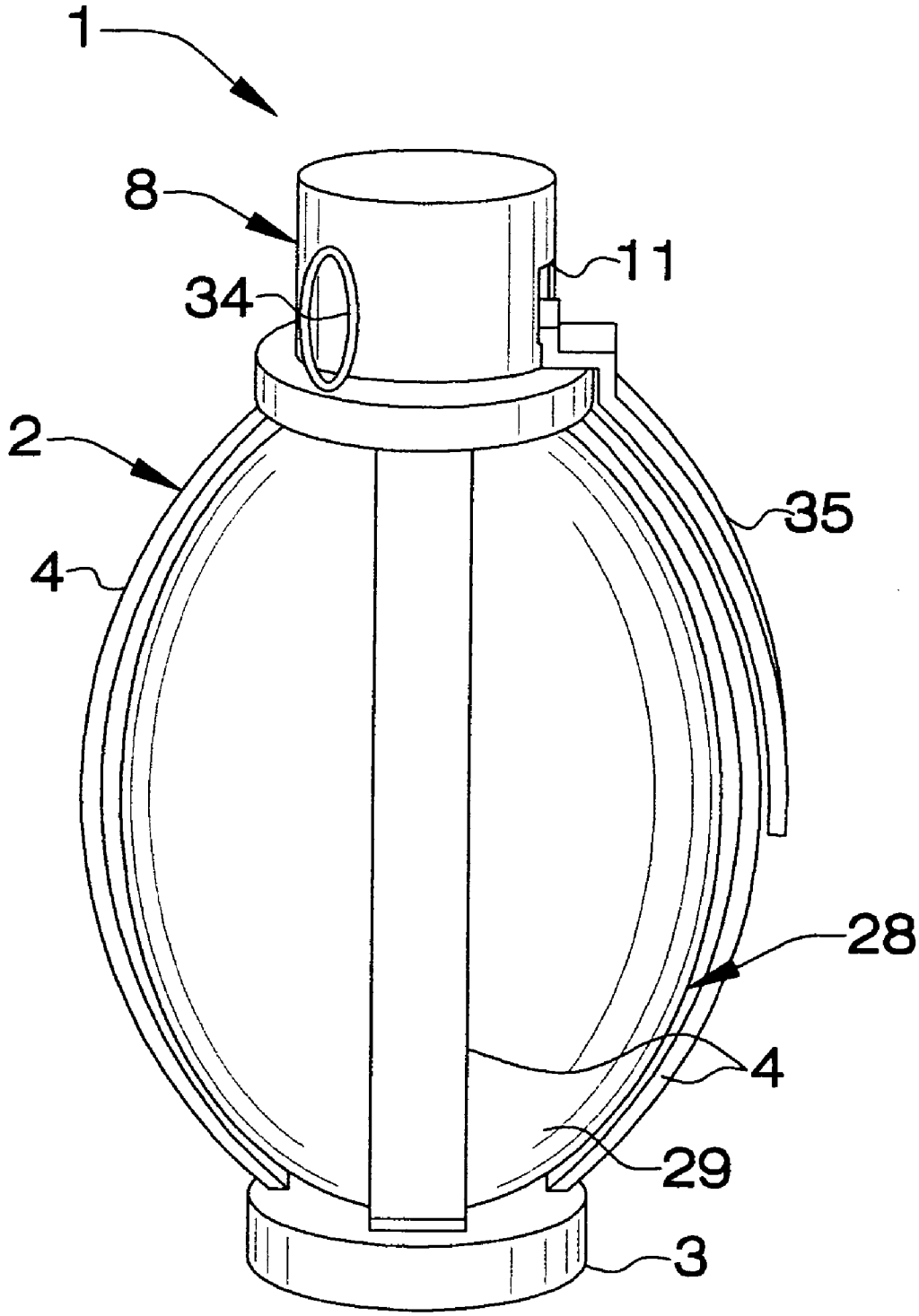
FIG. 1 is a perspective view of an illustrative embodiment of the paintball grenade.

A discharge housing 8 is provided on the cage cap 5 of the cage 2. The discharge housing 8 includes a housing base 9 typically having interior housing base threads 10 which threadably engage the cap threads 6 of the cage cap 5, as illustrated in FIG. 2. A spoon slot 11 (FIG. 1) and a pin opening 12 (FIG. 5), the purpose of which will be hereinafter described, are provided in the discharge housing 8.

Figure 3:
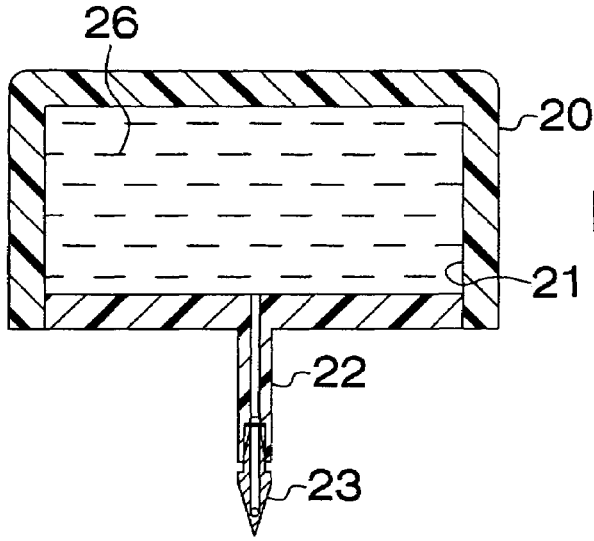
FIG. 3 is a sectional view of a vinegar syringe element of an illustrative embodiment of the paintball grenade.

As shown in FIG. 2, a syringe housing 14 is provided in the discharge housing 8. A vinegar syringe 20, the purpose of which will be hereinafter described, is slidably mounted in the syringe housing 14. As illustrated in FIG. 3, the vinegar syringe 20 has a syringe interior 21 which is adapted to contain vinegar 26. A discharge conduit 22, having a discharge tip 23, extends from the vinegar syringe 20 and is disposed in fluid communication with the syringe interior 21.

Figure 4:
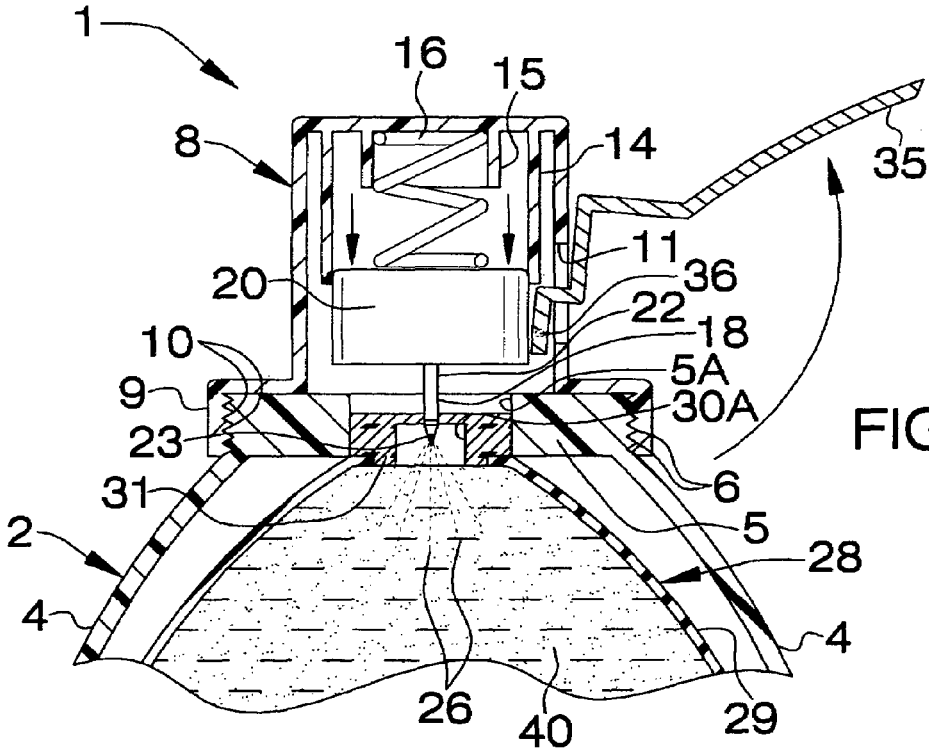
FIG. 4 is a sectional view of a discharge housing element of an illustrative embodiment of the paintball grenade, with a spoon element of the discharge housing disposed in a grenade-activating position.

As further shown in FIG. 2, a spring housing 15 is provided in the discharge housing 8 and is typically concentric with the syringe housing 14. A coiled spring 16 is seated in the spring housing 15 and engages the vinegar syringe 20. A spoon 35 extends through the spoon slot 11 and engages the vinegar syringe 20. The spoon 35 is pivotally attached to the discharge housing 8 via a pivot pin 36 (FIG. 4) in such a manner that the spoon 35 is positional between the inactivated configuration shown in FIG. 2 and the activated configuration shown in FIG. 4. In the inactivated configuration, the spoon 35 engages and holds the vinegar syringe 20 against the spring 16 as the spring 16 is compressed between the vinegar syringe 20 and the discharge housing 8, as shown in FIG. 2. In the activated configuration, the spoon 35 releases the vinegar syringe 20 and facilitates sliding movement of the vinegar syringe 20 in the syringe housing 14 by expansion of the spring 16, as shown in FIG. 4. A pull pin 34 (shown in section in FIG. 2) normally extends through the pin opening 12 (FIG. 5) and engages the vinegar syringe 20, as shown in FIG. 2, to prevent the spring 16 from inadvertently sliding the vinegar syringe 20 in the spring housing 15 in the event that the spoon 35 inadvertently releases the vinegar syringe 20. As shown in FIGS. 2 and 4, when the spoon 35 is pivoted from the inactivated configuration to the activated configuration, the discharge tip 23 of the discharge conduit 22 protrudes into the bladder cavity 5*a* of the cage cap 5. Furthermore, the discharge conduit 22 is configured in such a manner that the vinegar 26 in the syringe interior 21 of the vinegar syringe 20 is ejected through the discharge conduit 22 and discharged from the discharge tip 23 when the discharge tip 23 is compressed with respect to the discharge conduit 22, according to the knowledge of those skilled in the art.

A paint bladder 28 is detachably fitted between the cage base 3 and the cage cap 5 of the cage 2. The paint bladder 28 includes a bladder body 29 which is typically rubber. As shown in FIG. 4, paint/baking soda (sodium bicarbonate) mixture 40 having a paint of selected color is provided in the bladder body 29. A base bladder insert 30 and a cap bladder insert 31 are provided at respective ends of the bladder body 29. As shown in FIG. 4, a discharge cavity 30*a* is provided in the base bladder insert 30 and communicates with the bladder body 29. When fitted in the cage 2, the base bladder insert 30 is seated in the bladder cavity 3*a* of the base 3, whereas the cap bladder insert 31 is inserted in the bladder cavity 5*a* of the cage cap 5.

As shown in FIG. 2, when the spoon 35 is in the inactivated configuration, the discharge tip 23 of the vinegar syringe 20 is seated in a tip opening 18 which extends through the cage cap 5 and communicates with the bladder cavity 5*a* (FIG. 4) of the cage cap 5. Upon pivoting of the spoon 35 from the inactivated configuration to the activated configuration, the discharge tip 23 extends through the tip opening 18 (via expansion of the spring 16 against the vinegar syringe 20), through a registering opening (not shown) provided in the cap bladder insert 31 and into the bladder cavity 5*a* of the cage cap 5. Friction between the moving discharge tip 23 and the stationary edges of the tip opening 18 causes compression of the discharge tip 23 with respect to the discharge conduit 22, such that the vinegar 26 is discharged from the discharge tip 23 and into the bladder body 29 of the paint bladder 28, as shown in FIG. 4. Consequently, the vinegar 26 mixes with the paint/baking soda mixture 40, resulting in the release of carbon dioxide gas which ruptures the bladder body 29 of the paint bladder 28. This causes the paint 40 to forcefully discharge from the paint bladder 28 and contact persons (not shown), particularly participants in a paintball game, representing a "hit" on the participant or participants.

In typical application, the paintball grenade 1 is used as a simulated weapon in a paintball game. The paint bladder 28 can be placed in the cage 2 by pivoting one of the cage supports 4 at the support hinge 4*a* (FIG. 5) and inserting the base bladder insert 30 in the bladder cavity 3*a* (FIG. 2) of the base 3 and the cap bladder insert 31 in the bladder cavity 5*a* (FIG. 2) of the cage 2. The spoon 35 is initially maintained in the inactivated configuration shown in FIG. 2 as the paintball grenade 1 is carried by a paintball game participant. The pull pin 34 extends through the pin opening 12 (FIG. 5) and engages the vinegar syringe 20 to secure the vinegar syringe 20 in the inactivated position in the syringe housing 14, with the spring 16 compressed between the discharge housing 8 and the vinegar syringe 20. When activation of the paintball grenade 1 is desired, the pull pin 34 is initially removed from the pin opening 12 in the discharge housing 8. The spoon 35 is then pivoted from the inactivated configuration shown in FIG. 2 to the activated configuration shown in FIG. 4, such that the spoon 35 releases or disengages the vinegar syringe 20. Consequently, the spring 16 expands in the spring housing 15 and displaces the vinegar syringe 20 in the syringe housing 14, toward the cage cap 5 of the cage 2. The discharge tip 23 extends through the tip opening 18 and into the discharge cavity 30*a* in the base bladder insert 30 of the paint bladder 28, as shown in FIG. 4. Simultaneously, the discharge tip 23 is compressed with respect to the discharge conduit 22, such that the vinegar 26 is discharged from the discharge tip 23 and into the bladder body 29 of the paint bladder 28. The vinegar 26 mixes with the paint/baking soda mixture 40 in the bladder body 29, generating carbon dioxide gas which ruptures the bladder body 29. Consequently, the paint in the paint/baking soda mixture 40 is forcefully discharged from the bladder body 29 in a simulated hand grenade blast.

While the preferred embodiments of the invention have been described above, it will be recognized and understood that various modifications can be made in the invention and the appended claims are intended to cover all such modifications which may fall within the spirit and scope of the invention.

What is claimed is:

1. A paintball grenade, comprising:
a cage;
a discharge housing carried by said cage;
a vinegar syringe having a discharge tip carried by said discharge housing;
a spoon pivotally carried by said discharge housing and engaging said vinegar syringe; and
a paint bladder carried by said cage.

2. The paintball grenade of claim 1 wherein said cage comprises a cage base, a plurality of cage supports carried by said cage base and a cage cap carried by said plurality of cage supports, and wherein said discharge housing is carried by said cage cap of said cage.

3. The paintball grenade of claim 2 wherein at least one of said plurality of cage supports is pivotally carried by said cage base.

4. The paintball grenade of claim 1 further comprising a spring housing provided in said discharge housing and wherein said vinegar syringe is slidably mounted in said spring housing.

5. The paintball grenade of claim 1 further comprising a pin opening provided in said discharge housing and a pull pin extending through said pin opening and engaging said vinegar syringe.

6. The paintball grenade of claim 1 further comprising a housing base provided on said discharge housing and wherein said housing base detachably engages said cage.

7. The paintball grenade of claim 1 wherein said paint bladder comprises a bladder body and a first bladder insert and a second bladder insert carried by said bladder body and engaging said cage.

8. The paintball grenade of claim 1 further comprising a spring provided in said discharge housing and engaging said vinegar syringe.

9. A paintball grenade, comprising:
a cage;
a discharge housing carried by said cage;
a syringe housing provided in said discharge housing;
a vinegar syringe having a discharge tip slidably mounted in said syringe housing;
a spoon pivotally carried by said discharge housing and engaging said vinegar syringe; and
a paint bladder provided in said cage.

10. The paintball grenade of claim 9 wherein said cage comprises a cage base, a plurality of cage supports carried by said cage base and a cage cap carried by said plurality of cage supports, and wherein said discharge housing is carried by said cage cap of said cage.

11. The paintball grenade of claim 10 wherein at least one of said plurality of cage supports is pivotally carried by said cage base.

12. The paintball grenade of claim 9 further comprising a spring housing provided in said discharge housing and wherein said vinegar syringe is slidably mounted in said spring housing.

13. The paintball grenade of claim 9 further comprising a pin opening provided in said discharge housing and a pull pin extending through said pin opening and engaging said vinegar syringe.

14. The paintball grenade of claim 9 further comprising a housing base provided on said discharge housing and wherein said housing base detachably engages said cage.

15. The paintball grenade of claim 9 wherein said paint bladder comprises a bladder body and a first bladder insert and a second bladder insert carried by said bladder body and engaging said cage.

16. The paintball grenade of claim 9 further comprising a spring provided in said discharge housing and engaging said vinegar syringe.

17. A paintball grenade, comprising:
a cage;
a discharge housing carried by said cage;
a syringe housing provided in said discharge housing;
a vinegar syringe having a discharge tip slidably mounted in said syringe housing and containing vinegar;

a spring housing provided in said discharge housing;

a spring provided in said spring housing and engaging said vinegar syringe;

a spoon pivotally carried by said discharge housing and engaging said vinegar syringe; and a paint bladder provided in said cage and containing a mixture of paint and baking soda.

18. The paintball grenade of claim 17 wherein said cage comprises a cage base, a plurality of cage supports carried by said cage base and a cage cap carried by said plurality of cage supports, and wherein said discharge housing is carried by said cage cap of said cage.

19. The paintball grenade of claim 18 wherein said paint bladder comprises a bladder body, a first bladder insert carried by said bladder body and engaging said cage base of said cage and a second bladder insert carried by said bladder body and engaging said cage cap of said cage.

20. The paintball grenade of claim 17 further comprising a pin opening provided in said discharge housing and a pull pin extending through said pin opening and engaging said vinegar syringe.

* * * * *